US010933461B1

(12) United States Patent
Campbell

(10) Patent No.: US 10,933,461 B1
(45) Date of Patent: Mar. 2, 2021

(54) CHAIN LINK FENCE WITH IMPROVED SELVAGE AND METHOD OF MANUFACTURING

(71) Applicant: Randy Campbell, Barstow, CA (US)

(72) Inventor: Randy Campbell, Barstow, CA (US)

( * ) Notice: Subject to any disclaimer, the term of this patent is extended or adjusted under 35 U.S.C. 154(b) by 411 days.

(21) Appl. No.: 16/023,541

(22) Filed: Jun. 29, 2018

(51) Int. Cl.
*B21F 29/02* (2006.01)
*E04H 17/04* (2006.01)
*E04H 17/06* (2006.01)

(52) U.S. Cl.
CPC ..... *B21F 29/02* (2013.01); *E04H 17/04* (2013.01); *E04H 17/066* (2013.01)

(58) Field of Classification Search
CPC ..... B21F 29/02; E04H 17/04; E04H 17/066
USPC ..... 140/25, 30; 256/34
See application file for complete search history.

(56) References Cited

U.S. PATENT DOCUMENTS 2,753,156 A * 7/1956 Rieger ..... E01F 7/02 256/34
2,802,645 A * 8/1957 Rice ..... E04H 17/02 256/34
3,810,496 A * 5/1974 Rohrbacher ..... B21F 29/02 140/25
4,085,954 A * 4/1978 Thompson ..... B21F 29/02 256/34
4,723,761 A * 2/1988 Cluff ..... E04H 17/066 256/32
4,725,044 A * 2/1988 Cluff ..... E04H 17/066 245/11
4,860,997 A * 8/1989 Schoenheit ..... E04H 17/066 256/34
5,234,199 A * 8/1993 Cluff ..... E04H 17/066 256/34
5,275,381 A * 1/1994 Cluff ..... B21F 9/02 256/34
5,458,319 A * 10/1995 Mackay ..... E04H 17/066 256/34
5,465,941 A * 11/1995 Abbott ..... B21F 29/02 256/34

(Continued)

FOREIGN PATENT DOCUMENTS

CA 2169023 A1 * 8/1997 ..... E04H 17/066
FR 2476736 A1 * 8/1981 ..... E04H 17/066
GB 559159 A * 2/1944 ..... E04H 17/066

*Primary Examiner* — Josh Skroupa
(74) *Attorney, Agent, or Firm* — Gulf Coast Intellectual Property Group

(57) ABSTRACT

A chain link fence and a method of manufacturing an improved selvage therefore that provides no exposed ends of wires. The chain link fence of the present invention is manufactured from a plurality of wires coupled in a woven format so as to form loops. The chain link fence includes slats woven through the plurality of loops so as to provide privacy subsequent installation. The chain link fence manufacturing method provides for an improved selvage at the top and bottom thereof wherein the selvage has no exposed ends and as such eliminating the deficiencies of traditional selvages. The method of the present invention includes providing a plurality of bends to the exposed ends of the wire comprising the chain link fence. The plurality of bends culminates in the formation of a novel selvage that has the exposed ends of the wire penetrating into the body of the plurality of slats.

17 Claims, 2 Drawing Sheets

(56) References Cited

U.S. PATENT DOCUMENTS

| | | | | | |
|---|---|---|---|---|---|
| 5,482,256 | A * | 1/1996 | Caron | B21F 29/02 | 256/34 |
| 5,651,533 | A * | 7/1997 | Ling | E04H 17/066 | 256/34 |
| 5,775,676 | A * | 7/1998 | Hoggan | E04H 17/066 | 256/34 |
| 6,164,628 | A * | 12/2000 | Hoggan | E04H 17/066 | 256/34 |
| 6,402,127 | B1 * | 6/2002 | Meglino | E04H 17/066 | 256/1 |
| 7,165,760 | B2 * | 1/2007 | Campbell | E04H 17/066 | 256/34 |
| 7,237,766 | B2 * | 7/2007 | Lemay | E04H 17/066 | 256/34 |
| 2006/0033092 | A1 * | 2/2006 | Camacho | E04H 17/066 | 256/32 |
| 2014/0145133 | A1 * | 5/2014 | McClure | E04H 17/066 | 256/34 |
| 2017/0328084 | A1 * | 11/2017 | Hoggan | B21F 29/02 | |
| 2018/0128008 | A1 * | 5/2018 | Hoggan | E04H 17/066 | |

* cited by examiner

CHAIN LINK FENCE WITH IMPROVED SELVAGE AND METHOD OF MANUFACTURING

PRIORITY UNDER 35 U.S.C. Section 119(e) & 37 C.F.R. Section 1.78

This nonprovisional application claims priority based upon the following prior United States Provisional Patent Application entitled: Slat Retaining Apparatus for a Chain Link Fence, Application No.: 62/528,577 filed Jul. 5, 2017, in the name of Randy Campbell, which is hereby incorporated by reference for all purposes.

FIELD OF THE INVENTION

The present invention relates generally to fencing, more specifically but not by way of limitation, chain link fencing that incorporates integrated privacy slats wherein the fencing of the present invention includes an improved selvage that provides slat retention and reduced exposure for the selvage.

BACKGROUND

Chain link fences are well known in the art and are utilized for numerous commercial and residential purposes. Conventional chain link fences are manufactured from galvanized wire and are formed from a woven pattern thereof. Chain link fences provide an affordable option to other types of fence and can be use for applications such as but not limited to animal retention and crowd control. One drawback with the conventional chain link fence is the lack of privacy. Privacy slats can be installed subsequent the installation of the chain link fence or be pre-installed at the factory. As is known in the art, privacy slats are available in various configurations and are typically woven through the apertures of the chain link fence. Most privacy slats are manufactured from plastic and are commonly secured to the chain link fence utilizing staples or other similar techniques. The staples are often manufactured from a different type of metal which causes an undesirable cosmetic effect and further will often corrode resulting in issues of maintaining the position of the privacy slats.

Conventional chain link fencing utilizes two types of selvage. The two types of existing chain link fencing selvage are known as knuckle selvage and twist selvage. These existing types of selvage have widely recognized problems. During installation of chain link fencing with the existing selvage types it is very common to have snags and/or back-weaves, which results in additional labor time required for installation. Additionally, the existing selvage types have exposed ends that are sharp and are often the cause of injury to both those who install the chain link fence and others coming in contact therewith.

Accordingly, there is a need for a chain link fence having privacy slats that includes a novel selvage wherein the selvage is operable to provide privacy slat retention and be configured in a manner such that the end of the wire is not exposed.

SUMMARY OF THE INVENTION

It is the object of the present invention to provide chain link fence having pre-installed privacy slats with a novel selvage wherein the selvage of the present invention is configured to penetrate the privacy slat and provide retention thereof.

Another object of the present invention is to provide a chain link fence having privacy slats wherein the selvage of the present invention provides an end of wire that is bent and subsequently pierced into the body of the privacy slat so as to inhibit the exposure thereof.

A further object of the present invention is to provide a chain link fence having integrated privacy slats wherein subsequent the weaving of the chain link fence during the manufacturing process a bend is placed proximate the tip of the wire.

Still another object of the present invention is to provide a chain link fence having privacy slats wherein the selvage of the present invention wherein the selvage includes a second bend wherein the second bend is a continuation of a bend created by the chain link weaving machines during the manufacturing of the fence wherein the second bend includes bending the wire inwards so as to be parallel with a contiguous portion thereof.

An additional object of the present invention is to provide a chain link fence having integrated privacy slats wherein process of creating the selvage of the present invention includes a continuation of the bending process inwards and positioning parallel to a contiguous portion thereof.

Yet a further object of the present invention is to provide a chain link fence with privacy slats wherein the selvage creation process of the present invention includes a final bend wherein the final bend of the wire will pierce the first wall of the privacy slat.

Another object of the present invention is to provide a chain link fence having integrated privacy slats wherein final bend of the selvage creation process of the present invention terminates within the interior of the privacy slat and does not protrude through the second wall thereof.

Still an additional object of the present invention is to provide a chain link fence with privacy slats wherein the selvage of the present invention is operable to maintain the position of the privacy slat.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
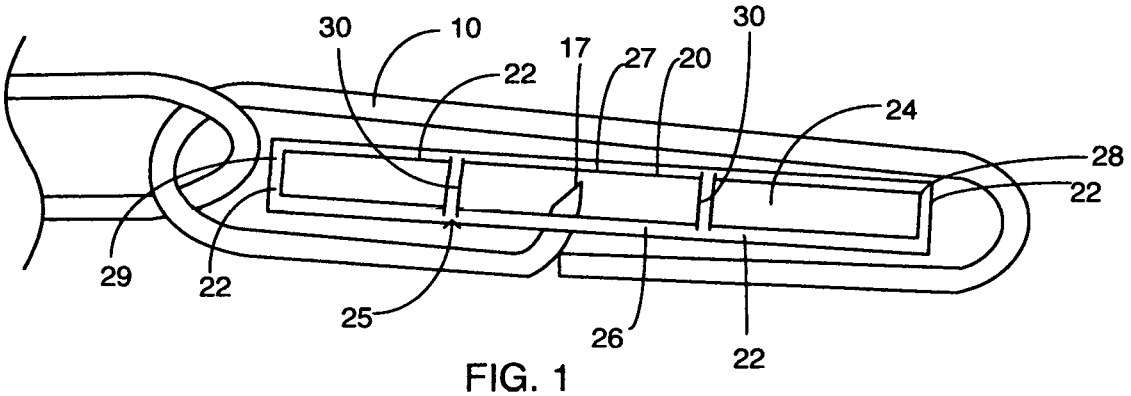
FIG. 1 is cross sectional view of the present invention.
Figure 2:
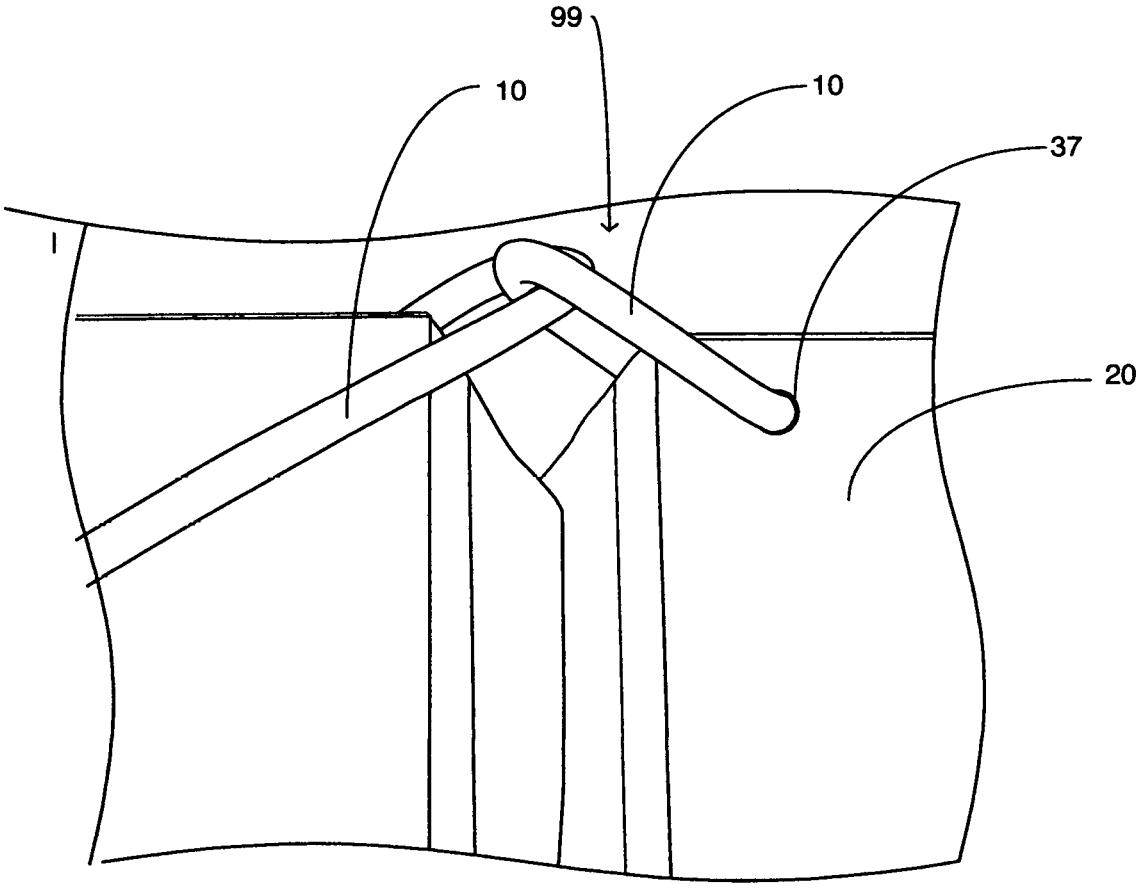
FIG. 2 is perspective view of the present invention.

Referring now to the drawings submitted herewith, wherein various elements depicted therein are not necessarily drawn to scale and wherein through the views and figures like elements are referenced with identical reference numerals, there is illustrated a chain link fence with privacy slat retention 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted as a part hereof, chain link fence with privacy slat retention 100 includes a weave of wire 10 that is weaved in a conventional manner in order to construct a chain link fence. The wire 10 is manufactured from a material such as but not limited to nine or ten gauge galvanized wire. It is contemplated within the scope of the present invention that the wire 10 could be manufactured from suitable alternative metals. The weaving of the wire 10 to construct a fence is performed utilizing conventional wire weaving machines and is well known in the art. The technique that will be described herein provides novel method applied to the ends of the wire 10 ensuing the conventional process of weaving in order to create a chain link fence. The chain link fence with privacy slat retention 100 further includes a privacy slat 20. The privacy slat 20 includes a plurality of walls 22 contiguously formed so as to create an interior volume 24. The body 25 of the privacy slat 20 includes a front wall 26, a rear wall 27 and opposing side walls 28,29. The front wall 26, a rear wall 27 and opposing side walls 28,29 are contiguously formed utilizing suitable durable techniques and the body 25 of the privacy slat 20 is manufactured from a material such as but not limited to plastic. The body 25 includes interior volume 24 so as to allow end 17 of the wire 10 to penetrate the front wall 26 but not comprise the rear wall 27 as will be further discussed herein. The body 25 further has disposed in the interior volume 24 thereof support members 30. The support members 30 are integrally formed with the front wall 26 and rear wall 27. The support members 30 are integrally formed with the front wall 26 and rear wall 27 extending therebetween and being perpendicular thereto. The support members 30 function to provide structural integrity for the body 25. While the drawings herein illustrate two support members 30 disposed within the interior volume 24 of the body 25, it is contemplated within the scope of the present invention that the body 25 could have less than or more than two support members 30 disposed within the interior volume 24.

Figure 3A:
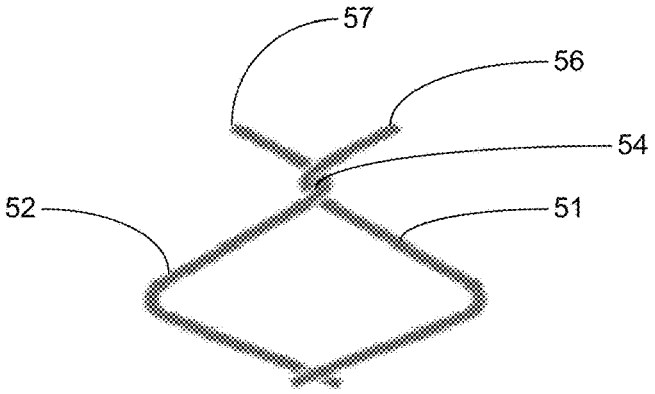
FIG. 3A through FIG. 3E is the method of the present invention for creation of the selvage thereof.
Figure 3B:
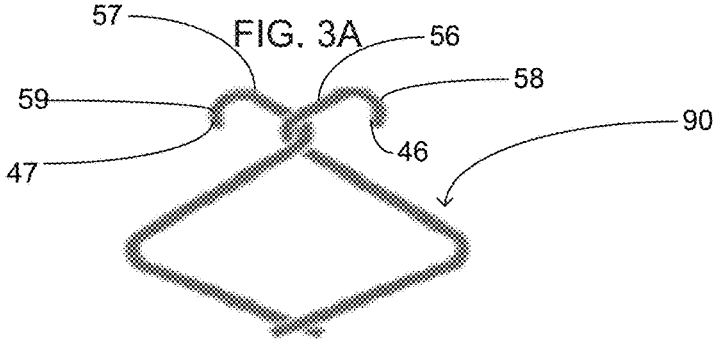

Referring now to FIGS. 3A through 3E, a description of the method of the present invention is illustrated therein. FIG. 3A shows a first wire 51 and a second wire 52 that have been woven together utilizing conventional techniques in order to create a portion of a chain link fence. A twist formation 54 is formed proximate the portions 56,57 operable to couple the first wire 51 and second wire 52. The portions 56,57 extend angularly outward from the twist formation 54. FIG. 3B illustrates the next step in creating the selvage 99 of the present invention. Section 58 of portion 56 is bent in a downward direction towards loop 90. In the preferred embodiment of the present invention the section 58 is about a quarter of an inch in length. While a quarter of an inch in length is preferred for section 58, it is contemplated within the scope of the present invention that the section 58 could be greater and/or shorter in length than a quarter of an inch. Portion 57 is subsequently similarly bent wherein section 59 is bent in a downward direction towards loop 90. Section 59 is approximately the same length as section 58.

Figure 3C:
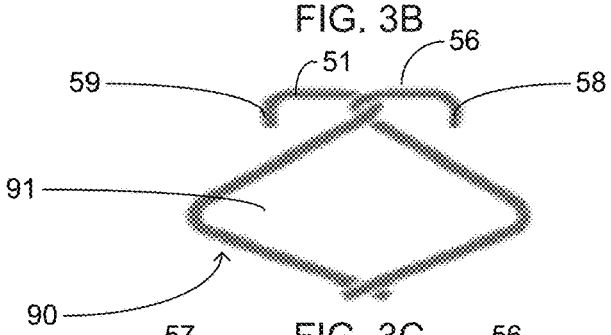
Figure 3D:
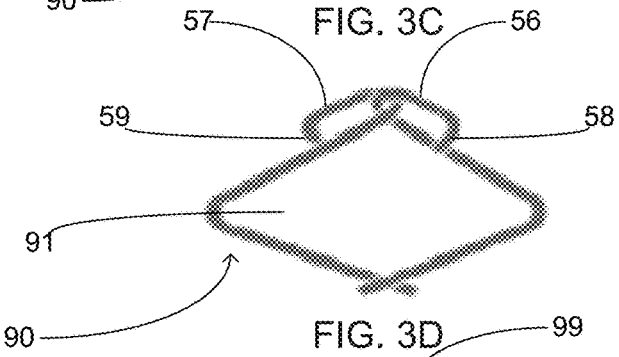
Figure 3E:
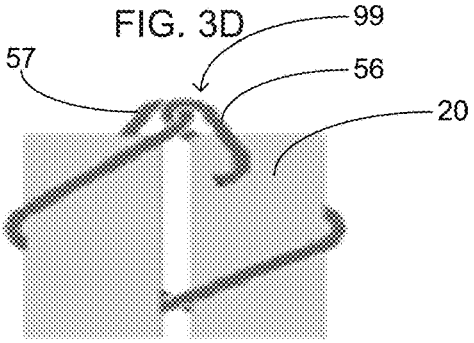

Illustrated herein in FIG. 3C is the next step to create the selvage 99 of the present invention. Following the aforementioned steps illustrated in FIG. 3B, the portion 56 and portion 57 are bent utilizing suitable techniques in a downward manner towards loop 90. The portions 56, 57 are bent until the portion 56,57 are in axial alignment with each other and are further in a level horizontal position. FIG. 3D illustrates the next step in creating the selvage 99 of the present invention. Subsequent placing the portions 56,57 in a level horizontal position, force is applied thereto wherein the portions 56,57 are bent downward towards the opening 91 of the loop 90. It should be understood that portions 56,57 have not been bent such that the tips 46, 47 have propagated into the opening 91 of the loop 90 so as to allow for the insertion of a privacy slat 20 therein. FIG. 3E illustrates the final step in creating the selvage 99 of the present invention. A slat 20 is introduced into the opening 91 of the loop 90. Subsequently, the portions 56,57 are bent inwards towards the opening 91 of the loop 90 so as to penetrate the tips 46,47 into the front wall 26 and rear wall 27 respectively. As illustrated herein in FIG. 1, the tips 46, 47 only penetrate the front wall 26 and rear wall 27 respectively and do not extend through the interior volume 24 so as to penetrate the opposing wall. This ensures the tips 46,47 are maintained within the interior volume 24 of the body 25. Penetration of the tips 46,47 creates aperture 37. Ensuing the execution of the aforementioned steps illustrated herein in FIGS. 3A-3E, the selvage 99 of the present invention is formed. It should be understood by those skilled in the art that two wires 51,52 were utilized for discussion purposes and that the creation of a fence would utilize more than two wires. It should be further understood within the scope of the present invention that various techniques and/or machinery could be utilized to perform the bends of the method of the present invention.

While a preferred embodiment of creating a selvage 99 has been discussed herein and illustrated in FIGS. 3A-3E, it is contemplated within the scope of the present invention that alternative embodiments of creating the selvage 99 are within the spirit and scope of the present invention. Not by way of limitation, sections 58,59 and specifically the bending thereof could be eliminated from the procedure described herein. In this alternative embodiment the portions 56, 57 would be bent so as to be firmly adjacent the front wall 26 and rear wall 27 but the tips 46,47 would not penetrate the walls 22. The portions 56,57 would be at least slightly embedded into the walls 22 but not penetrating therethrough.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A method of manufacturing a chain link fence that includes privacy slats comprising the steps of:

providing a plurality of wires, said plurality of wires being manufactured from galvanized metal;

weaving said plurality of wires so as to form a chain link fence, wherein the chain link fence subsequent the weaving of the plurality of wires has exposed ends and wherein the exposed ends are operably coupled in pairs;

executing a first bend of the exposed ends of the plurality of wires, wherein the first bend includes bending a tip section of each end of said plurality of wires;

performing a second bend, said second bend resulting in the exposed ends of the plurality of wires are placed in axial alignment;

implementing a third bend, wherein the exposed end of the plurality of wires are bent inwards toward the chain link fence;

providing a plurality of slats, said plurality of slats being woven into the chain link fence; and securing said plurality of slats within the chain link fence, said plurality of slats being secured utilizing a fourth bend of the exposed ends of said plurality of wires.

2. The method as recited in claim 1, wherein said fourth bend includes bending the exposed ends of the plurality of wires so as to penetrate said plurality of slats.

3. The method as recited in claim 2, wherein the tip section of the first bend is approximately one quarter of an inch in length.

4. The method as recited in claim 3, wherein in the second bend the exposed ends of the plurality of wires are moved to a position such that the exposed ends are in a level horizontal position.

5. The method as recited in claim 4, wherein the fourth bend further includes penetration of the tip section into the plurality of slats.

6. The method as recited in claim 5, wherein the plurality slats include a plurality of walls contiguously formed to create a body of the slats, said body of said slats having an interior volume.

7. The method as recited in claim 6, wherein in the fourth bend the tip section penetrates one of said plurality of walls of said plurality of slats so as to be disposed in said interior volume.

8. A method of manufacturing a chain link fence having a top and a bottom wherein the loops of the chain link fence include privacy slats journaled therethrough comprising the steps of:

providing a plurality of wires, said plurality of wires being manufactured from galvanized metal, said plurality of wires being woven into a chain link fence having a multitude of loops, said plurality of wires having exposed ends at the top and bottom of the chain link fence, wherein the exposed ends are operably coupled in pairs;

performing a first bend of the exposed ends of the plurality of wires, wherein the first bend includes bending a tip section of each end of said plurality of wires;

performing a second bend, said second bend resulting in the exposed ends of the plurality of wires are placed in axial alignment wherein the exposed ends are directionally opposite such that the ends are approximately one hundred and eighty degrees apart;

implementing a third bend, wherein the exposed ends of the plurality of wires are bent inwards toward the chain link fence;

providing a plurality of slats, said plurality of slats being woven into the chain link fence, said plurality of slats being manufactured from plastic, said plurality of slats having a body, said body of said plurality of slats being manufactured from a plurality of walls being contiguously formed, said body of said slats having an interior volume; and implementing a fourth bend, said fourth bend being performed on said exposed ends of said plurality of wires, said fourth bend resulting in the piercing of the body of said plurality of slats by said tip section.

9. The method of manufacturing a chain link fence as recited in claim 8, wherein completion of the fourth bend provides a selvage for the chain link fence that has no exposed ends of wire.

10. The method of manufacturing a chain link fence as recited in claim 9, wherein said body of said plurality of slats further include a front wall and a rear wall.

11. The method of manufacturing a chain link fence as recited in claim 10, wherein said plurality of slats further include at least one support member, said at least one support member extending intermediate said front wall and said rear wall of said body.

12. The method of manufacturing a chain link fence as recited in claim 11, wherein in said fourth bend said tip section of said exposed ends are penetrated into said front wall and said rear wall of said body of said plurality of slats.

13. The method of manufacturing a chain link fence as recited in claim 12, wherein in said second bend said exposed ends are in a level horizontal position.

14. A method of manufacturing a chain link fence having a top and a bottom wherein the loops of the chain link fence include privacy slats journaled therethrough comprising the steps of:

providing a plurality of wires, said plurality of wires being manufactured from galvanized metal, said plurality of wires being woven into a chain link fence having a multitude of loops, said plurality of wires having exposed ends at the top and bottom of the chain link fence, wherein the exposed ends are operably coupled in pairs;

performing a first bend of the exposed ends of the plurality of wires, wherein the first bend includes bending a tip section of each end of said plurality of wires;

performing a second bend, said second bend resulting in the exposed ends of the plurality of wires are placed in axial alignment wherein the exposed ends are directionally opposite such that the ends are approximately one hundred and eighty degrees apart;

implementing a third bend, wherein the exposed ends of the plurality of wires are bent inwards toward the chain link fence;

providing a plurality of slats, said plurality of slats being woven into the chain link fence, said plurality of slats being manufactured from plastic, said plurality of slats having a body, said body of said plurality of slats being manufactured from a plurality of walls being contiguously formed, said body of said slats having an interior volume, wherein said body of said plurality of slats further include a front wall and a rear wall; and implementing a fourth bend, said fourth bend being performed on said exposed ends of said plurality of wires, said fourth bend resulting in the piercing of the body of said plurality of slats by said tip section and wherein completion of the fourth bend provides a selvage for the chain link fence that has no exposed ends of wire.

15. The method of manufacturing a chain link fence as recited in claim 14, wherein said plurality of slats further include at least one support member, said at least one support member extending intermediate said front wall and said rear wall of said body.

16. The method of manufacturing a chain link fence as recited in claim 15, and further including the step of forming an aperture, said aperture being formed in the body of said plurality of slats, said aperture being formed by penetration of said tip sections into said body.

17. The method of manufacturing a chain link fence as recited in claim 16, wherein the selvage has no exposed ends and wherein the ends of the plurality of wires are disposed within the interior volume of said body of said plurality of slats.

* * * * *